US012187570B2

(12) United States Patent
Hirose

(10) Patent No.: US 12,187,570 B2
(45) Date of Patent: Jan. 7, 2025

(54) WINDING DEVICE

(71) Applicant: HIBOT CORPORATION, Tokyo (JP)

(72) Inventor: Shigeo Hirose, Tokyo (JP)

(73) Assignee: HIBOT CORPORATION, Tokyo (JP)

( * ) Notice: Subject to any disclaimer, the term of this patent is extended or adjusted under 35 U.S.C. 154(b) by 258 days.

(21) Appl. No.: 17/759,179

(22) PCT Filed: Jan. 21, 2020

(86) PCT No.: PCT/JP2020/001997
§ 371 (c)(1),
(2) Date: Jul. 20, 2022

(87) PCT Pub. No.: WO2021/149166
PCT Pub. Date: Jul. 29, 2021

(65) Prior Publication Data

US 2023/0072525 A1 Mar. 9, 2023

(51) Int. Cl.
*B65H 54/12* (2006.01)
*B65H 54/28* (2006.01)

(52) U.S. Cl.
CPC ..... *B65H 54/12* (2013.01); *B65H 54/28* (2013.01)

(58) Field of Classification Search
CPC .... B65H 54/12; B65H 54/28; B65H 54/2848; B65H 54/2827; B65H 75/4402; B65H 75/4405; B65H 57/14
See application file for complete search history.

(56) References Cited

U.S. PATENT DOCUMENTS 1,735,036 A * 11/1929 Caldwell ..... B65H 54/28 242/482.6
2,869,797 A * 1/1959 Clerc ..... B65H 54/32 242/477.3
3,240,438 A * 3/1966 Baselice ..... B65H 59/36 242/413.5
3,604,647 A 9/1971 Le Compte et al.
4,428,540 A 1/1984 Calcagno et al.
(Continued)

FOREIGN PATENT DOCUMENTS

CN 113080503 * 7/2021
EP 0518853 A1 12/1992
(Continued)

OTHER PUBLICATIONS

"Cable Coiling Machine", Zeng, Jinrong, Jul. 9, 2021, English Translation (Year: 2021).*
(Continued)

*Primary Examiner* — William A. Rivera
(74) *Attorney, Agent, or Firm* — MASUVALLEY & PARTNERS; Peter Martinez

(57) ABSTRACT

A winding device provided with an inlet for drawing a string-shaped winding target member and configured to wind the winding target member includes: a drum having flanges at both end portions of a body in an axial direction thereof and provided rotatably about the an axis of the body, a drive source configured to rotate the drum, a first guide portion configured to draw the winding target member along a first axis arranged substantially perpendicularly to the axis of the body in a skew relationship, a swing member provided swingably about the first axis, and a second guide portion attached to a tip end of the swing member to guide the winding target member from the first guide portion to the drum.

5 Claims, 5 Drawing Sheets

(56) References Cited

U.S. PATENT DOCUMENTS

| | | | | |
|---|---|---|---|---|
| 4,499,707 | A * | 2/1985 | Desjobert | B65H 67/0434 493/414 |
| 6,505,791 | B1 * | 1/2003 | Syndikus | B65H 54/34 242/475.7 |
| 6,592,066 | B1 * | 7/2003 | Hermanns | H02K 33/18 310/19 |
| 2001/0042808 | A1 * | 11/2001 | Klaus | B65H 54/2884 242/483.8 |
| 2004/0021031 | A1 * | 2/2004 | Klaus | B65H 54/2848 242/397.3 |
| 2008/0061181 | A1 * | 3/2008 | Bateman | B65H 54/28 242/520 |
| 2017/0088388 | A1 * | 3/2017 | Lillich | B65H 54/2848 |

FOREIGN PATENT DOCUMENTS

| | | | |
|---|---|---|---|
| FR | 2524452 | A1 | 10/1983 |
| JP | H10-193470 | A | 7/1998 |
| JP | 2002-179337 | A | 6/2002 |
| JP | 2015-221710 | A | 12/2015 |
| JP | 2020-090351 | A | 6/2020 |

OTHER PUBLICATIONS

WIPO, Japan International Search Authority, International Search Report (with English translation) and Written Opinion mailed Apr. 21, 2020 in International Patent Application No. PCT/JP2020/001997, 8 pages.

European Patent Office, Extended European Search Report dated Feb. 20, 2023 in European Patent Application No. 20915355.0, 8 pages.

WIPO, Switzerland International Bureau, International Preliminary Report on Patentability with English Translation mailed Jul. 26, 2022 in International Patent Application No. PCT/JP2020/001997, 8 pages.

* cited by examiner

WINDING DEVICE

RELATED APPLICATIONS

This application is the U.S. National Phase of and claims priority to International Patent Application No. PCT/JP2020/001997, International Filing Date Jan. 21, 2020, entitled Winding Device, which is incorporated herein by reference in its entirety.

TECHNICAL FIELD

The present invention relates to a winding device configured to wind a string-shaped winding target member such as a cable. Specifically, the present invention relates to a winding device configured to wind a winding target member in parallel.

BACKGROUND ART

Typically, the technique of decreasing a fleet angle for winding a winding target member in parallel around a drum, i.e., winding the winding target member in line around the drum has been employed. The fleet angle indicates an angle between a line connecting the drum and the center of an inlet for guiding the winding target member to the drum and a line connecting the inside of an end of the drum and the center of the inlet. With a great fleet angle, the winding target member is not wound in parallel, but is wound in a bump shape in the vicinity of the center due to a great force of returning the winding target member to the center even when an attempt is made to wind the winding target member around the end of the drum. On the other hand, in the case of a small fleet angle with the same drum width, a distance between the drum and the inlet is long, and for this reason, the entire size of the winding device is large. This problem is particularly noticeable in a winding device with dust and water resistance enhanced by a configuration in which an inlet is provided at a case and a drum is housed in the case.

For this reason, a winding device has been proposed, which includes a half-ring-shaped swing member arranged along a circumferential direction of a drum and configured to swing about an axis perpendicular to the axis of the drum (see Patent Literature 1). In this winding device, a winding target member is guided from an inlet to a center portion of the half-ring-shaped swing member, and is wound around the drum. A biasing unit is provided at the swing member to bias the swing member to the center. When the drum rotates and the winding target member moves to one flange side accordingly, the swing member tends to tilt to the flange side due to the tension of the winding target member. However, such tilting is reduced by the biasing unit, and therefore, the swing member can smoothly follow the motion of the winding target member moving along the entire surface of the drum. With this configuration, the winding target member can be wound in parallel around the drum.

According to the winding device configured as described above, the inlet and the drum can be positioned close to each other. However, the spring modulus of the biasing unit needs to be changed according to the tension of the winding target member. The tension of the winding target member normally fluctuates, and there is room for improvement for practical use.

CITATION LIST

Patent Literature

PATENT LITERATURE 1: JP-A-2015-221710

SUMMARY OF THE INVENTION

Problems to be Solved by the Invention

The present invention is intended to provide a winding device configured to wind a winding target member in parallel regardless of the tension of the winding target member while an inlet can be positioned close to a drum by a simple structure.

Solution to the Problems

For solving the above-described problems, a winding device according to a first aspect of the present invention is, for example, a winding device 10 provided with an inlet 100 for drawing a string-shaped winding target member 90 and configured to wind the winding target member 90 as shown in FIGS. 1(*a*), 1(*b*) and 2. The winding device 10 includes a drum 20 having flanges 24, 26 at both end portions of a body 22 in an axial direction of the body 22 and provided rotatably about an axis 28 of the body 22, a drive source 30 configured to rotate the drum 20, a first guide portion 40 configured to draw the winding target member 90 along a first axis 48 arranged substantially perpendicularly to the axis 28 of the body in a skew relationship, a swing member 60 provided swingably about the first axis 48, and a second guide portion 50 attached to a tip end of the swing member 60 to guide the winding target member 90 from the first guide portion 40 to the drum 20. The second guide portion 50 is attached to the swing member 60 such that a winding-portion winding target member 92 to be wound around the drum 20 from the second guide portion 50 is substantially parallel with the first axis 48. The winding target member 90 is wound around the drum 20 through the first guide portion 40 and the second guide portion 50.

With this configuration, the winding target member guided from the inlet along the first axis arranged substantially perpendicularly to the axis of the body in the skew relationship is wounded using the first guide portion and the second guide portion attached to the swing member such that the winding-portion winding target member to be wound around the drum from the second guide portion is substantially parallel with the first axis. Thus, even with great tension, the direction of the tension and a swing direction of the swing member are perpendicular to each other, and therefore, the swing member is easily swingable. That is, the winding-portion winding target member to be wound around the drum is easily movable in a width direction of the drum. While pushed by the winding target member previously wound around the drum, the winding target member is wound in parallel around the drum. Thus, the winding device configured to wind the winding target member in parallel is provided so that the inlet can be arranged at the position close to the drum and the entirety of the device can be compactified by a simple structure.

A winding device according to a second aspect of the present invention is, for example, configured such that the second guide portion 50 includes a second pulley 52 supported on the swing member 60 as shown in FIGS. 1(*a*) and 1(*b*). With this configuration, since the second guide portion includes the pulley and is moved in the width direction of the drum by swing of the swing member, the winding target member can be guided by a simple structure with less resistance because of use of the pulley.

A winding device according to a third aspect of the present invention is, for example, configured such that the first guide portion 40 includes a first pulley 42 supported on the swing member 60 as shown in FIGS. 1(*a*) and 1(*b*). With this configuration, since the first pulley of the first guide portion and the second pulley of the second guide portion are supported on the swing member swinging about the first axis, the winding target member can be guided to the drum by a simple structure with less resistance.

A winding device according to a fourth aspect of the present invention is, for example, configured such that the swing member 60 has a balance weight 62 on the opposite side of the first axis 48 from the second guide portion 50 as shown in FIG. 2. With this configuration, since the swing member has the balance weight on the side opposite to the second guide portion, the center of gravity of the swing member is moved closer to the first axis so that moment due to, e.g., the weight of the swing member itself at the position of the first axis can be reduced. Thus, the swing member is easily swingable about the first axis.

A winding device according to a fifth aspect of the present invention is, for example, configured such that the first guide portion 40 has the first pulley 44 on the opposite side of the first axis 48 from the second guide portion 50, the winding target member 90 is wound the half or more of the circumference of the first pulley 44, and the rotation axis 46 of the first pulley 44 is inclined with respect to the axis 28 of the body, as shown in FIG. 3. With this configuration, since the first pulley is positioned on the opposite side of the first axis from the second guide portion, the center of gravity of the swing member is moved closer to the first axis so that the moment due to, e.g., the weight of the swing member itself at the position of the first axis can be reduced. Thus, the swing member is easily swingable about the first axis. Moreover, since the rotation axis of the first pulley is inclined with respect to the axis of the body, intersection of the winding target member can be avoided.

A winding device according to a sixth aspect of the present invention is, for example, configured such that the first guide portion 40 includes, on the opposite side of the first axis 48 from the second guide portion 50, the first pulley 70 and a third pulley 74 supported on the swing member 60 and the winding target member 90 is sent to the second pulley 52 by way of the first pulley 70 and the third pulley 74, as shown in FIG. 4. With this configuration, since the first pulley and the third pulley are positioned on the opposite side of the first axis from the second guide portion, the center of gravity of the swing member is moved closer to the first axis so that the moment due to, e.g., the weight of the swing member itself at the position of the first axis can be reduced. Thus, the swing member is easily swingable about the first axis.

Effects of the Invention

According to the winding device of the present invention, the winding target member guided along the first axis arranged substantially perpendicularly to the axis of the body in the skew relationship is wounded using the first guide portion and the second guide portion attached to the swing member such that the winding-portion winding target member to be wound around the drum from the second guide portion is substantially parallel with the first axis. Thus, the winding target member is wound in parallel around the drum. Consequently, the winding device configured to wind the winding target member in parallel is provided so that the inlet can be arranged at the position close to the drum and the entirety of the device can be compactified by a simple structure. Specifically, in a winding device with dust and water resistance enhanced by a configuration in which an inlet is provided at a case and, e.g., a drum is housed in the case, the case can be compactified, and therefore, more prominent advantageous effects can be provided.

DESCRIPTION OF THE EMBODIMENTS

Figure 1:
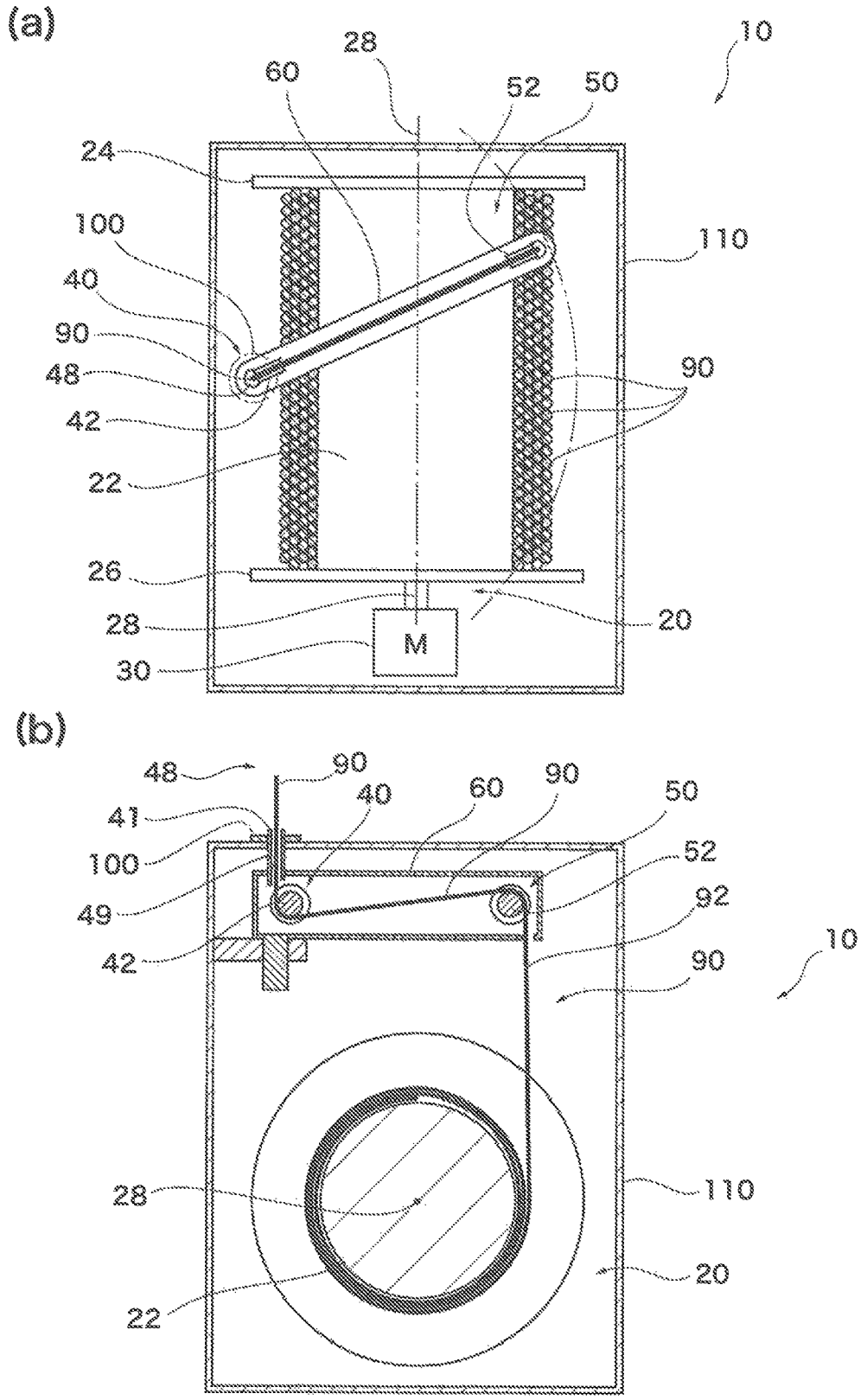
FIGS. 1(*a*) and 1(*b*) show views for describing a winding device as an embodiment of the present invention, FIG. 1(*a*) being a plan view, FIG. 1(*b*) being a side view, and these views showing the inside of the winding device through a case.

Hereinafter, embodiments of the present invention will be described with reference to the drawings. Note that the same reference numerals are used to represent the same or equivalent devices in each figure and overlapping description thereof will be omitted.

First, a winding device 10 as an embodiment of the present invention will be described with reference to FIGS. 1(*a*), 1(*b*) and 2. The winding device 10 has a drum 20 around which a string-shaped winding target member 90 is to be wound, a drive source 30 configured to rotate the drum 20, a first guide portion 40 for drawing the winding target member 90, and a second guide portion 50 for guiding the winding target member 90 to the drum 20. Further, the winding device 10 has a case 110 housing therein these devices and provided with an inlet 100 through which the winding target member 90 is to be drawn. The string-shaped winding target member 90 may be, but not limited to, a power line or a communication cable, for example.

The drum 20 has flanges 24, 26 at both end portions of a body 22 in an axial direction thereof, and is held so as to be able to rotate about the axis 28 of the body 22. In the present embodiment, the body 22 has a cylindrical shape, but the shape thereof is not specifically limited as long as the winding target member 90 can be wound around the body 22. The drum 20 rotates about the axis 28, and accordingly, the winding target member 90 is wound around the body 22. The flanges 24, 26 are members extending in a radial direction of the body 22 to avoid detachment of the winding target member 90 from the body 22, and for example, are formed in a discoid shape. However, the flanges 24, 26 may be formed of, for example, multiple rod members.

The drum 20 is rotated about the axis 28 by the drive source 30. The drive source 30 may be a well-known device including, for example, a motor and a reducer; a motor, a chain, and a sprocket; and a motor, a belt, and a pulley. The motor is not limited to an electric type, and may be of an oil or water pressure drive type and may obtain rotary force by an engine. The method for coupling the drum 20 and the drive source 30 to each other is not specifically limited.

The first guide portion 40 draws the winding target member 90 along a first axis 48 arranged substantially perpendicularly to the axis 28 of the body in a skew relationship. The skew relationship described herein indicates that the first axis 48 does not intersect the axis 28 of the body. That is, the winding target member 90 is not directly wound around the drum 20, but is wound around the drum 20 after having been bent at the later-described second guide portion 50 such that the direction thereof is changed from that of the first guide portion 40. The first axis 48 arranged substantially perpendicularly to the axis 28 of the body indicates that the winding target member 90 is drawn from a substantially radial direction of the body 22, and is not necessarily in precise perpendicular arrangement. In the present embodiment, the first guide portion 40 includes: a hole 49 formed at a later-described swing member 60 for drawing the winding target member 90; and a first pulley 42. The winding target member 90 is guided from the outside to the first guide portion 40 through the inlet 100 formed at the case 110. For guiding the winding target member 90 through the inlet 100 along the first axis 48, a guide tube 41 (see FIGS. 1(*a*) and 1(*b*)) may be provided. Note that the winding target member 90 is tensioned upon winding because the winding target member 90 is supported on, e.g., another instrument (not shown) on the upper side as viewed in FIGS. 1(*a*) and 1(*b*) or due to the weight of the winding target member 90 itself, for example.

The second guide portion 50 guides the winding target member 90 from the first guide portion 40 to the drum 20. The second guide portion 50 is positioned in a direction substantially perpendicular to the axis 28 of the body and the first axis 48 with respect to the first guide portion 40. Moreover, the winding target member 90 extending from the second guide portion 50 toward the body 22 is arranged at a position substantially perpendicular to the axis 28 of the body. That is, the winding target member 90 drawn along the first axis 48 arranged substantially perpendicularly to the axis 28 of the body in the skew relationship and a winding-portion winding target member 92 as the winding target member 90 to be wound around the drum from the second guide portion 50 are substantially parallel with each other. In the present embodiment, the second guide portion 50 includes a second pulley 52.

The first pulley 42 of the first guide portion 40 and the second pulley 52 of the second guide portion 50 are rotatably supported on the swing member 60. The swing member 60 is supported so as to be able to swing about the first axis 48. The configuration for supporting the swing member 60 is not specifically limited, and for example, the swing member 60 may be supported by a support pin (not shown) substantially coaxial with the first axis 48 or be hung from the guide tube 41 (see FIGS. 1(*a*) and 1(*b*)) substantially coaxial with the first axis 48 as long as the swing member 60 can be swingably supported. The second pulley 52 is arranged at a tip end of the swing member 60. The "tip end" as described herein indicates a distal end of the swing member 60 with respect to the first axis 48, and is not necessarily precisely an end portion. The swing member 60 swings about the first axis 48, and accordingly, the second pulley 52 reciprocates on an arc about the first axis 48 by the width of the drum 20, i.e., between two flanges 24, 26, and the winding target member 90 is wound in parallel around the body 22 of the drum 20. Note that in a precise sense, the second pulley 52 does not necessarily precisely reciprocate about the first axis 48, but may only be supported substantially at such a position that the second pulley 52 is reciprocatable in a width direction of the drum 20. Moreover, the swing member 60 is arranged such that the winding target member 90 between the first pulley 42 and the second pulley 52 is at a substantially right angle to the winding target member 90 drawn along the first axis 48 and the winding-portion winding target member 92.

Figure 2:
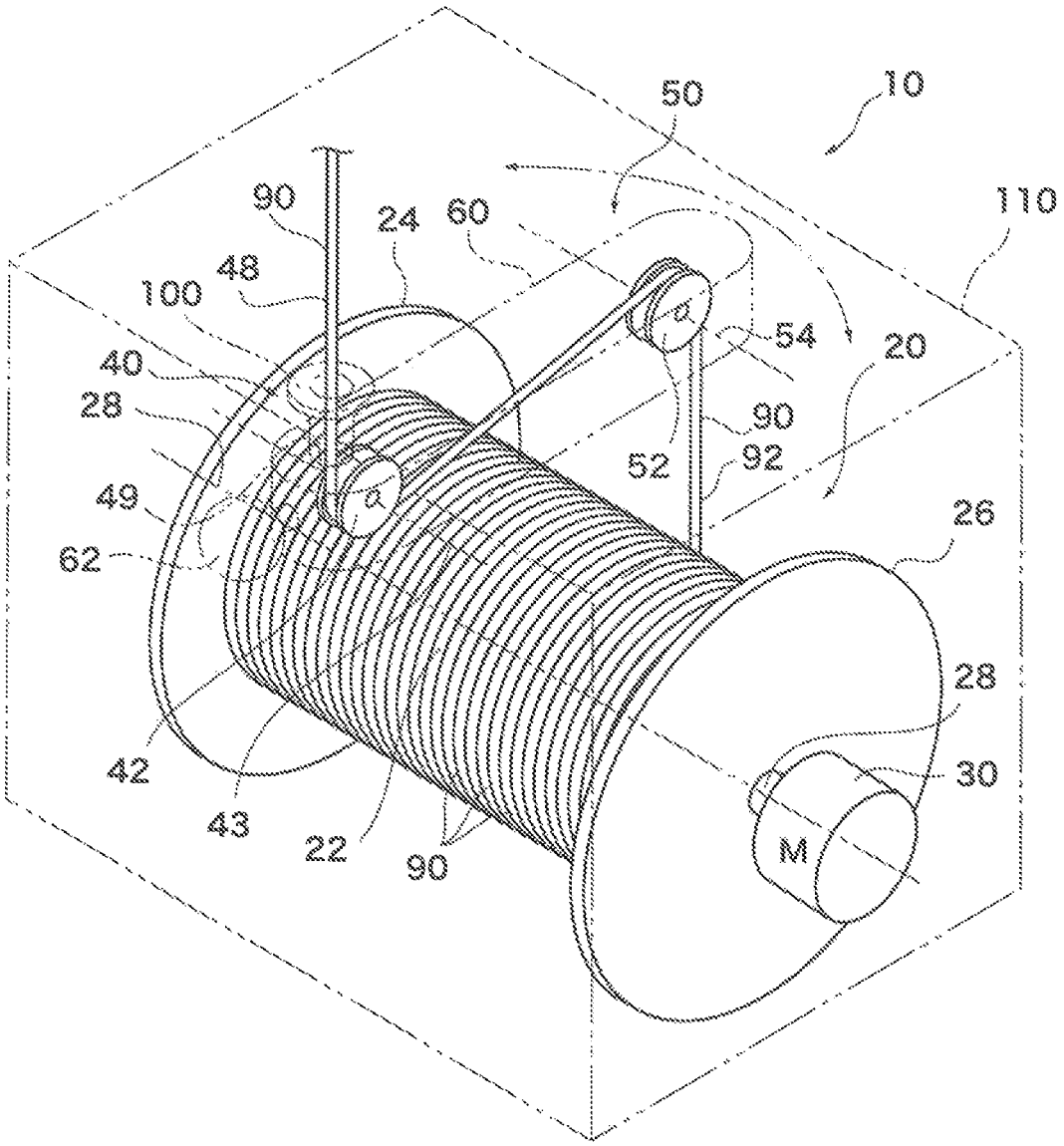
FIG. 2 shows a perspective view of the winding device shown in FIGS. 1(*a*) and 1(*b*), FIG. 2 showing the inside of the winding device through the case.

As shown in FIG. 2, the hole 49 for drawing the winding target member 90 may be formed at the swing member 60. However, the swing member 60 may only be configured to rotatably support the first pulley 42 of the first guide portion 40 and the second pulley 52 of the second guide portion 50, and for example, may be formed of beams. In this case, the hole 49 is not formed, and the winding target member 90 may be drawn through between the beams.

As shown in FIG. 2, the swing member 60 may have a balance weight 62 on the opposite side of the first axis 48 from the second guide portion 50. The balance weight 62 is a weight for cancelling or reducing moment about the vicinity of the first axis 48, i.e., a support point, due to, e.g., the weight of the swing member 60 itself because of a longer second-guide-portion-50 side length of the swing member 60. When the center of gravity of the swing member 60 is shifted from the first axis 48 as the center of swing, the swing member 60 tilts and becomes less swingable. The center of gravity of the entirety of the swing member 60 is shifted closer to the first axis 48 by the balance weight 62, and accordingly, tilting of the posture of the swing member 60 due to, e.g., the weight of the swing member 60 can be avoided in any posture of the winding device 10. Thus, the swing member 60 smoothly follows movement of the second guide portion 50 upon winding of the winding target member 90 around the drum 20.

In the winding device 10, the winding target member 90 is guided to the first guide portion 40 along the first axis 48. The winding target member 90 is guided to the second guide portion 50 after the direction of the winding target member 90 has been changed at the first guide portion 40, and then, the winding target member 90 is wound around the drum 20 after the direction of the winding target member 90 has been changed at the second guide portion 50. Thus, the inlet 100 can be positioned close to the drum 20. In the winding device 10, when the drum 20 is rotated by drive force of the drive source 30, the winding target member 90 is pulled through the second pulley 52. The winding-portion winding target member 92 to be wound around the body 22 of the drum 20 first comes into contact with the winding target member 90 previously wound around the body 22, and then, slides on the winding target member 90. Accordingly, the winding-portion winding target member 92 is wound in parallel with and next to the winding target member 90. At this point, the swing member 60 swings about the first axis 48, and accordingly, the second guide portion 50 moves in the width direction of the drum 20. Since the second guide portion 50 moves in the width direction of the drum 20, the winding-portion winding target member 92 is easily wound in parallel. At this point, the winding-portion winding target member 92 is substantially parallel with the first axis 48, and the winding target member 90 is sent at a substantially right angle to the second pulley 52 from the first pulley 42 by the swing member 60. Thus, even if great tension is caused on the winding target member 90, the direction of the winding target member 90 is perpendicular to a swing direction of the swing member 60, and therefore, the swing member 60 is easily swingable. The "substantially parallel" and "substantially perpendicular/perpendicularly" as described herein do not precisely indicate "parallel" and "perpendicular/perpendicularly," but are merely used to indicate such a direction of arrangement of the winding target member 90 that the swing member 60 can swing even if tension is caused on the winding target member 90. Actually, when the winding target member 90 is wound by the winding device 10, not only the direction (substantially parallel with the first axis 48) of drawing of the winding target member 90 but also the winding target member 90 in the winding device 10 constantly change. For example, the direction of the winding-portion winding target member 92 also changes due to the number of turns of the winding target member 90 wound around the body 22. Because of this situation, the terms "substantially parallel" and "substantially perpendicular/perpendicularly" are used.

Figure 3:
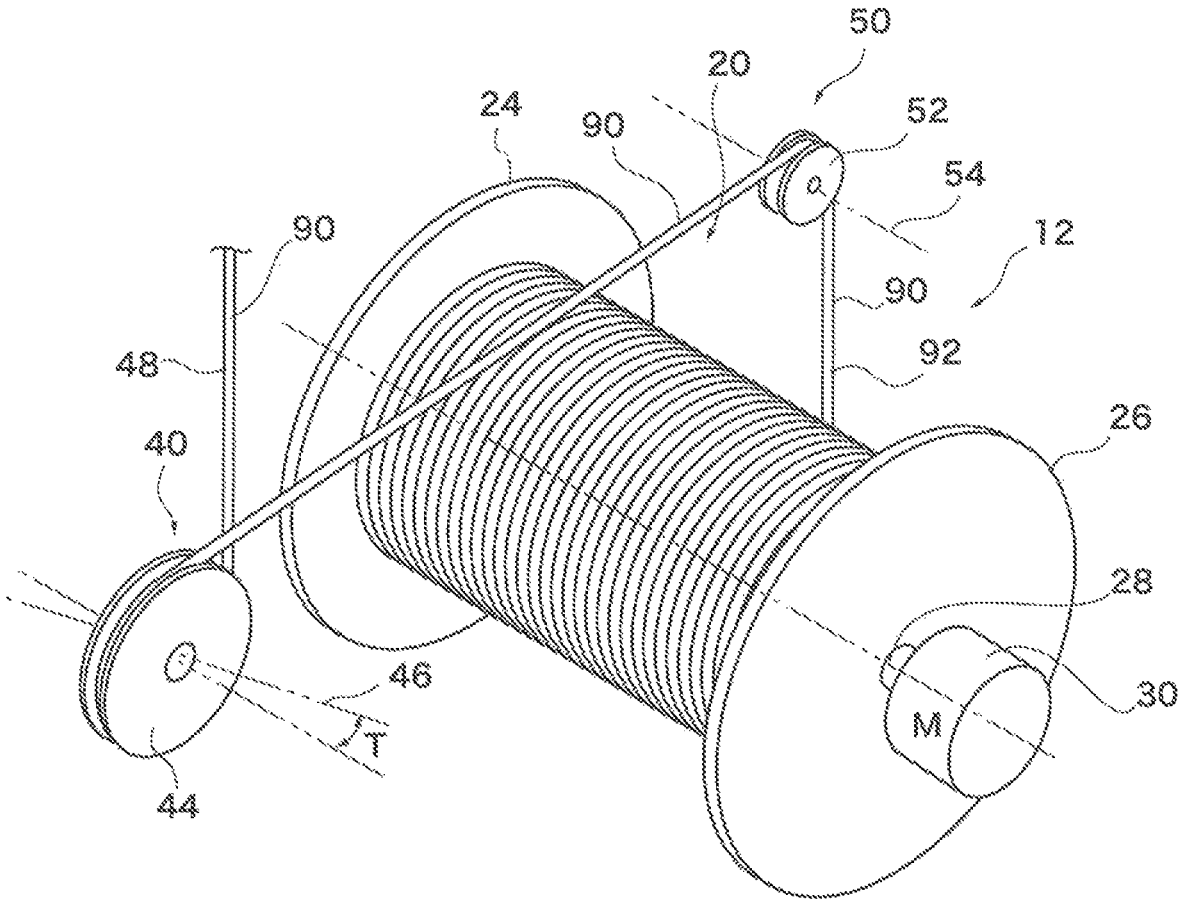
FIG. 3 shows a perspective view for describing a winding device different from that shown in FIGS. 1(*a*), 1(*b*) and 2, FIG. 3 not showing a case.

Subsequently, a winding device 12 as an embodiment of the present invention will be described with reference to FIG. 3. The winding device 12 is different from the winding device 10 in that the path of a winding target member 90 extends the half or more of the circumference of a first pulley 44 of a first guide portion 40 and the first pulley 44 is inclined for avoiding intersection between the winding target member 90 sent to the first pulley 44 along a first axis 48 and the winding target member 90 sent to a second guide portion 50 from the first pulley 44. However, since other configurations are the same as those of the winding device 10, overlapping description thereof will be omitted. Note that a swing member 60 is not shown in FIG. 3.

In the winding device 12, the first pulley 44 of the first guide portion 40 is arranged on the opposite side of the first axis 48 from the second guide portion 50. The case where the first pulley 44 is arranged on the opposite side of the first axis 48 from the second guide portion 50 as described herein indicates that the rotation axis 46 of the first pulley 44 is arranged on the opposite side of the first axis 48 from the second guide portion 50. Thus, moment generated about the vicinity of the first axis 48 as a support point due to, e.g., a weight on a second guide portion 50 side and moment generated due to a weight on a first guide portion 40 side are cancelled out each other or reduced. Accordingly, advantageous effects similar to those of the balance weight 62 as described with reference to FIG. 2 are provided, and the swing member 60 is easily swingable about the support point.

In the winding device 10, the axis 28 of the body 22 of the drum 20, the rotation axis 43 of the first pulley 42, and the rotation axis 54 of the second pulley 52 are substantially parallel with each other. On the other hand, in the winding device 12, the rotation axis 46 of the first pulley 44 is inclined such that the intersection between the winding target member 90 sent to the first pulley 44 along the first axis 48 and the winding target member 90 sent to the second guide portion 50 from the first pulley 44 is avoided. That is, the rotation axis 46 of the first pulley 44 is inclined with respect to the axis 28 of the body 22. An inclination direction may be the up-down direction, the horizontal direction (the direction of the second guide portion 50), or an oblique direction therebetween. An inclination angle T is preferably small because resistance upon winding of the winding target member 90 is small.

Figure 4:
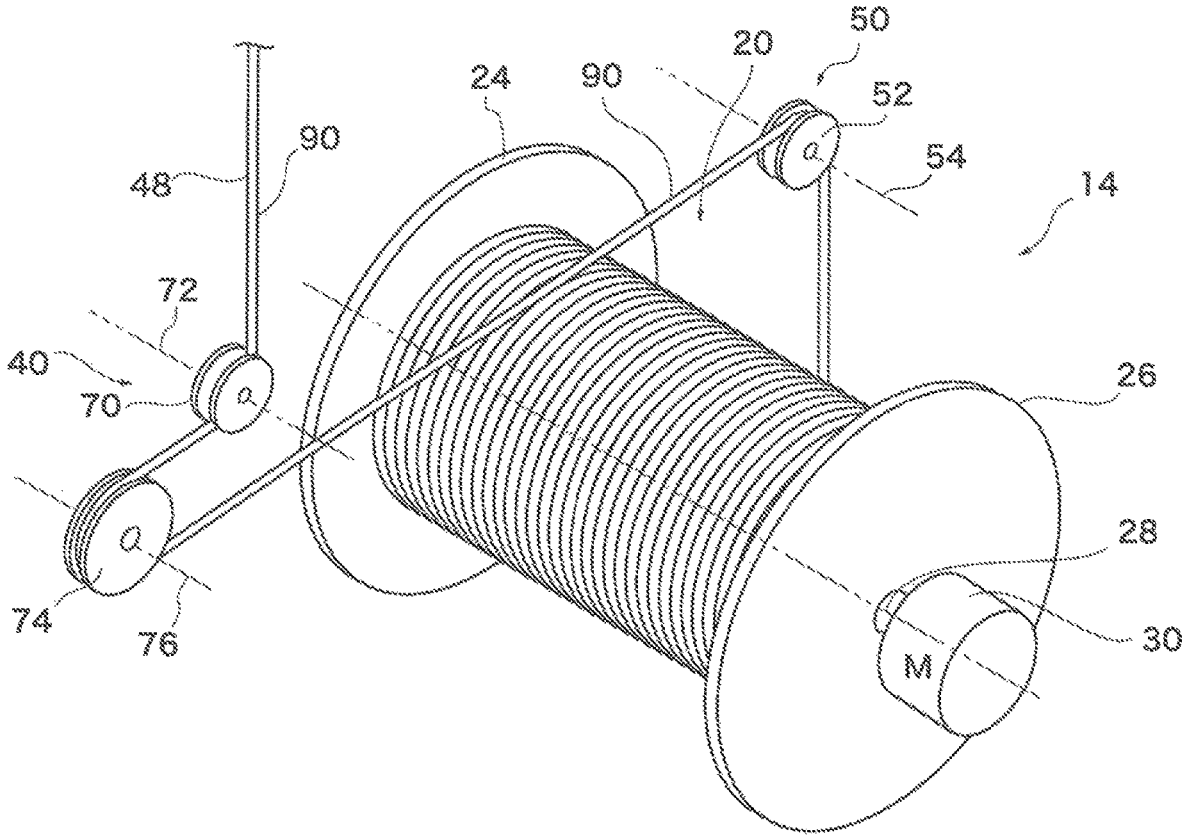
FIG. 4 shows a perspective view for describing still another winding device, FIG. 4 not showing a case.

Next, a winding device 14 as an embodiment of the present invention will be described with reference to FIG. 4. The winding device 14 is different from the winding devices 10, 12 in that a first guide portion 40 has a first pulley 70 and a third pulley 74, the first pulley 70 and the third pulley 74 are arranged on the opposite side of a first axis 48 from a second guide portion 50, and a winding target member 90 is sent to a second pulley 52 by way of the first pulley 70 and the third pulley 74. However, other configurations are the same as those of the winding devices 10, 12, and therefore, overlapping description thereof will be omitted. The case where the first pulley 70 and the third pulley 74 are arranged on the opposite side of the first axis 48 from the second guide portion 50 as described herein indicates that the rotation axis 72 of the first pulley 70 and the rotation axis 76 of the third pulley 74 are arranged on the opposite side of the first axis 48 from the second guide portion 50. Note that a swing member 60 is not shown in FIG. 4.

In the winding device 14, the first pulley 70 and the third pulley 74 of the first guide portion 40 are arranged on the opposite side of the first axis 48 from the second guide portion 50. Thus, moment generated about the vicinity of the first axis 48 as a support point due to, e.g., a weight on a second guide portion 50 side and moment generated due to a weight on a first guide portion 40 side are cancelled out each other or reduced. Accordingly, advantageous effects similar to those of the balance weight 62 as described with reference to FIG. 2 are provided, and the swing member 60 is easily swingable about the support point. Note that as clearly shown in FIG. 4, in the winding device 14, the winding target member 90 sent to the first pulley 70 along the first axis 48 and the winding target member 90 sent to the second guide portion 50 from the third pulley 74 do not intersect each other and the rotation axis 72 of the first pulley 70 and the rotation axis 76 of the third pulley 74 are substantially parallel with the axis 28 of a body 22 and the rotation axis 54 of the second pulley 52.

In the winding devices 10, 12, 14 as described above, the inlet 100 can be positioned close to the drum 20 and the winding target member 90 can be wound in parallel without influence of, e.g., the tension of the winding target member 90 by a simple structure. Thus, the entirety of each of the winding devices 10, 12, 14 can be compactified. Further, the winding target member 90 is guided through the inlet 100 with each of the winding devices 10, 12, 14 being housed in the compact case 110, and therefore, dust and water resistance can be provided.

In description above, each of the winding devices 10, 12, 14 has been described as one housed in the case 110 having the inlet 100 for drawing the winding target member 90, but depending on intended use, the case 110 does not necessarily provided. That is, it may be configured such that a main portion (in the case of the winding devices 10, 12, the drum 20, the drive source 30, the first guide portion 40, the second guide portion 50, and the like) of each of the winding devices 10, 12, 14 is supported by a support device and, e.g., a tube as the inlet 100 is supported in the vicinity of the main portion by a support device.

In description above, the first guide portion 40 and the second guide portion 50 have been described as those including the pulleys 42, 44, 52, but instead of the pulleys, may have a well-known structure for sending the winding target member 90 after the direction thereof has been changed, such as a groove with a smooth surface.

Figure 5:
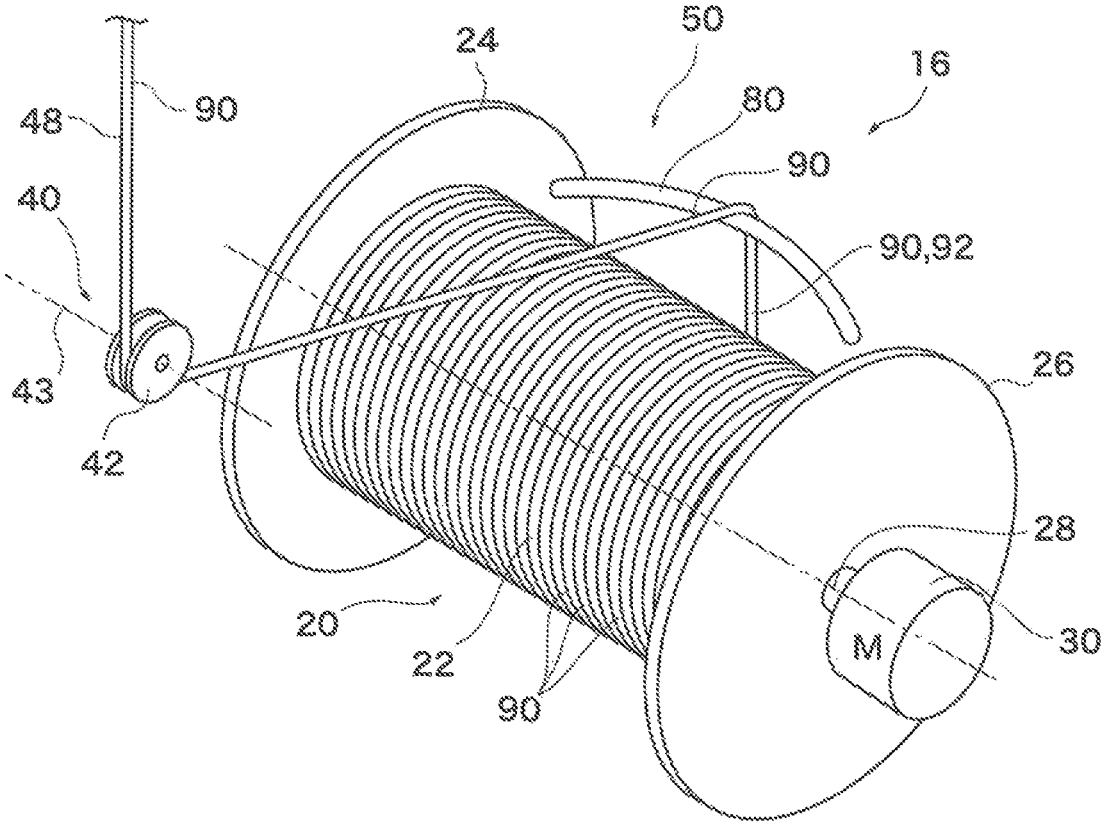
FIG. 5 shows a perspective view for describing still another winding device having an arc-shaped guide instead of a swing member, FIG. 5 not showing a case.

Note that as shown in FIG. 5, a winding device 16 may be configured such that a second guide portion 50 includes no pulley, a swing member 60 is not provided, and a second guide portion 50 is an arc-shaped guide 80. Note that other configurations are the same as those of the winding device 10, and therefore, overlapping description thereof will be omitted.

The arc-shaped guide 80 is a rod-shaped member configured to guide a winding target member 90 such that the winding target member 90 is wound around a drum 20 after the direction of the winding target member 90 has been changed on an arc with an equal distance from a first guide portion 40. By the guide 80 instead of the pulley 52 of the second guide portion 50 of the swing member 60, the position of the winding target member 90 to be wound around the drum 20 is easily moved in a width direction of the drum 20. A surface of the guide 80 is smoothed such that the winding target member 90 smoothly slides thereon, and the material of the guide 80 is selected from those allowing the winding target member 90 to easily slide thereon. A pulley configured to smoothly slide along the guide 80 may be utilized such that the winding target member 90 smoothly slides. Note that a direction change at the position with the equal distance from the first guide portion 40 is for positioning a winding-portion winding target member 92, which is to be wound around the drum 20 from the second guide portion 50, substantially in parallel with the winding target member 90 drawn along a first axis 48. For example, in a case where the guide is in the form of a straight line parallel with a body 22 of the drum 20, the winding target member 90 changes the direction thereof to a direction oblique to the guide as a winding position moves closer to either end. For this reason, the force of returning the winding target member 90 to a right-angle position with the shortest distance is generated. Thus, the winding target member 90 is wound in the vicinity of the center such that the turns of the winding target member 90 overlap with each other in the vicinity of the center, and is not wound at both ends. As a result, the winding target member 90 cannot be wound in parallel. On the other hand, if the winding-portion winding target member 92 is, as in the case of the guide 80, substantially parallel with the winding target member 90 drawn along the first axis 48, i.e., is at a right angle to the body 22 of the drum 20, no force of shortening a path is generated.

As described above, in the winding device 16, an inlet 100 can be positioned close to the drum 20 and the winding target member 90 can be wound in parallel without influence of, e.g., the tension of the winding target member 90 by a simple structure. Thus, the entirety of the winding device 16 can be compactified. Further, the winding target member 90 is guided through the inlet 100 with the winding device 16 being housed in a compact case 110, and therefore, dust and water resistance can be provided.

LIST OF REFERENCE NUMERALS

10, 12, 14, 16 Winding Device
20 Drum
22 Body
24, 26 Flange
28 Axis of Body
30 Drive Source
40 First Guide Portion
41 Guide Tube
42, 44 First Pulley
43, 46 Rotation Axis of First Pulley
48 First Axis
49 Hole for Drawing Winding Target Member
50 Second Guide Portion
52 Second Pulley
54 Rotation Axis of Second Pulley
60 Swing Member
62 Balance Weight
70 First Pulley
72 Rotation Axis of First Pulley
74 Third Pulley
76 Rotation Axis of Third Pulley
80 Arc-Shaped Guide
90 Winding Target Member
92 Winding-Portion Winding Target Member
T Angle of Inclination of Rotation Axis of Second Guide Portion

The invention claimed is:

1. A winding device provided with an inlet for drawing a winding target member and configured to wind the winding target member, the winding device comprising:

a drum having flanges at both end portions of a body in an axial direction of the body and provided rotatably about an axis of the body;

a drive source configured to rotate the drum;

a first guide portion configured to draw the winding target member along a first axis arranged substantially perpendicularly to the axis of the body in a skew relationship;

a swing member provided swingably about the first axis; and a second guide portion attached to a tip end of the swing member to guide the winding target member from the first guide portion to the drum, wherein the second guide portion is attached to the swing member such that a winding-portion winding target member to be wound around the drum from the second guide portion is substantially parallel with the first axis, and the winding target member is wound around the drum through the first guide portion and the second guide portion, the first guide portion includes a first pulley supported on the swing member, the second guide portion includes a second pulley supported on the swing member, the first guide portion includes, on the opposite side of the first axis from the second guide portion, the first pulley and a third pulley supported on the swing member, and the winding target member is sent to the second pulley by way of the first pulley and the third pulley.

2. The winding device according to claim 1, wherein the swing member has a balance weight on an opposite side of the first axis from the second guide portion.

3. The winding device according to claim 1, wherein the first guide portion has the first pulley on the opposite side of the first axis from the second guide portion, the winding target member is wound a half or more of a circumference of the first pulley, and a rotation axis of the first pulley is inclined with respect to the axis of the body.

4. A winding device provided with an inlet for drawing a winding target member and configured to wind the winding target member, the winding device comprising:

a drum having flanges at both end portions of a body in an axial direction of the body and provided rotatably about an axis of the body;

a drive source configured to rotate the drum;

a first guide portion configured to draw the winding target member along a first axis arranged substantially perpendicularly to the axis of the body in a skew relationship;

a swing member provided swingably about the first axis; and a second guide portion attached to a tip end of the swing member to guide the winding target member from the first guide portion to the drum, wherein the second guide portion is attached to the swing member such that a winding-portion winding target member to be wound around the drum from the second guide portion is substantially parallel with the first axis, and the winding target member is wound around the drum through the first guide portion and the second guide portion, the first guide portion includes a first pulley supported on the swing member, the second guide portion includes a second pulley supported on the swing member, the swing member has a balance weight on an opposite side of the first axis from the second guide portion, the first guide portion has the first pulley on the opposite side of the first axis from the second guide portion, the winding target member is wound a half or more of a circumference of the first pulley, and a rotation axis of the first pulley is inclined with respect to the axis of the body.

5. A winding device provided with an inlet for drawing a winding target member and configured to wind the winding target member, the winding device comprising:

a drum having flanges at both end portions of a body in an axial direction of the body and provided rotatably about an axis of the body;

a drive source configured to rotate the drum;

a first guide portion configured to draw the winding target member along a first axis arranged substantially perpendicularly to the axis of the body in a skew relationship;

a swing member provided swingably about the first axis; and a second guide portion attached to a tip end of the swing member to guide the winding target member from the first guide portion to the drum, wherein the second guide portion is attached to the swing member such that a winding-portion winding target member to be wound around the drum from the second guide portion is substantially parallel with the first axis, and the winding target member is wound around the drum through the first guide portion and the second guide portion, the first guide portion includes a first pulley supported on the swing member, the second guide portion includes a second pulley supported on the swing member, the swing member has a balance weight on an opposite side of the first axis from the second guide portion, the first guide portion includes, on the opposite side of the first axis from the second guide portion, the first pulley and a third pulley supported on the swing member, and the winding target member is sent to the second pulley by way of the first pulley and the third pulley.

* * * * *